United States Patent [19]

Riker

[11] Patent Number: 4,892,441

[45] Date of Patent: Jan. 9, 1990

[54] APPARATUS AND A METHOD FOR DISTRIBUTING CONCRETE AND SIMILAR MATERIALS TO SELECTED POINTS OF USE

[75] Inventor: Rudolf Riker, Memmingen, Fed. Rep. of Germany

[73] Assignee: Messrs. Stetter GmbH, Dr. Karl-Lenz-Str., Memmingen, Fed. Rep. of Germany

[21] Appl. No.: 328,248

[22] Filed: Mar. 24, 1989

[30] Foreign Application Priority Data

Apr. 7, 1988 [DE] Fed. Rep. of Germany ..... 3811585

[51] Int. Cl.[4] ..... E21D 11/00

[52] U.S. Cl. ..... 405/146; 249/11; 425/64; 405/150

[58] Field of Search ..... 405/146, 147, 150; 249/10, 11; 425/64

[56] References Cited

U.S. PATENT DOCUMENTS 4,147,453 4/1979 Unger et al. ..... 405/141

4,687,374 8/1987 Babenderescle et al. ..... 405/146

FOREIGN PATENT DOCUMENTS 3610118 10/1987 Fed. Rep. of Germany ..... 405/146

*Primary Examiner*—Dennis L. Taylor

*Assistant Examiner*—Arlen L. Olsen

*Attorney, Agent, or Firm*—Notaro & Michalos

[57] ABSTRACT

This invention is both an apparatus and a method for distributing concrete coming from a concrete pump to anyone of a plurality of points of use. An intermediate conduit is connected with a main supply conduit and the intermediate conduit comprises a plurality of branch points connected in series by the intermediate conduit. At each branch point a short branch pipe is connected with the intermediate conduit. All branch pipes can be completely plugged by rubber plugs. A discharge conduit is connected with the end of the intermediate conduit and a draining device can be operatively connected with the discharge conduit to force a deformable plug through the intermediate conduit and at least a part of the supply conduit in order to drain and cleanse the whole system before setting of the concrete will begin. The draining process is activated at the end of a working day or working period and can be automatically started after a predetermined stop period of the concrete pump.

21 Claims, 11 Drawing Sheets

FIG. 11
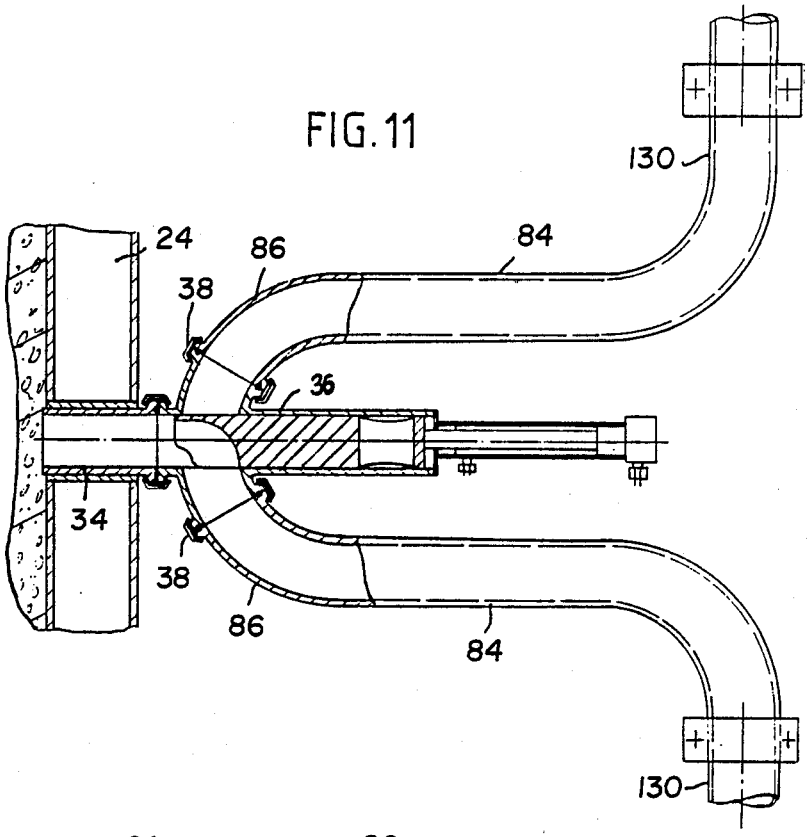
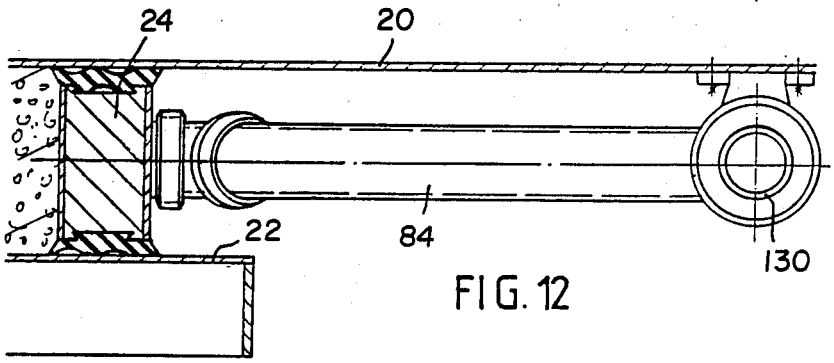
FIG. 12

APPARATUS AND A METHOD FOR DISTRIBUTING CONCRETE AND SIMILAR MATERIALS TO SELECTED POINTS OF USE

BACKGROUND OF THE INVENTION

The invention refers to an apparatus and a method for distributing concrete especially in tunnels. For lining a tunnel by an annular concrete shell an outer mould ring, an inner mould ring and an annular front mould are used to form an annular mould chamber rearwardly closed by a previously formed concrete shell section. A concrete pump positioned in a rearward area of the tunnel supplies concrete into the mould chamber via a long supply conduit. A plurality of branch pipes are connected with the supply conduit by means of shut-off valves and lead into the annular mould chamber at peripherally spaced injection points.

DESCRIPTION OF THE PRIOR ART

A known apparatus uses a cross-tube connected with the supply conduit and four branch pipes connected with the cross-tube. The branch-pipes extend radially outwards and then are bent in longitudinal direction rearwards to project through the annular front mould. A shut-off valve is provided in each radial section of the branch pipes. Only one valve is opened at a time, while maintaining the other valves in closed position, so that the concrete is delivered to one injection point at a time and when sufficient concrete has been so delivered such valve is closed and another valve is opened, so that concrete is then delivered to the next selected point of use. Retarding agents must be used for the concrete preparation in order to avoid setting of the concrete in the filled branch pipes. Without using such retarding agents each one of the plurality of branch pipes had to be dismounted after having been filled with concrete and had to be manually drained and cleansed by use of water and then had to be reassembled. The same has to be done at the end of a working day or period even if retarding agents are used. The concrete in the supply conduit can be removed by using a press-out device blowing or forcing a cleaning plug through the relatively long supply conduit. Also in a case of a breakdown of the concreting plant or an interruption of the operation of the cutting head the complete pipe system must be drained and cleansed in order to avoid setting of the concrete in the system.

OBJECTS OF THE INVENTION

It is an object of this invention to provide an improved distributing apparatus and method that eliminates disassembling of the branch pipes for draining. A further object of this invention is to provide an apparatus and method for distributing concrete without using retarding agents therein but nevertheless avoiding setting of the concrete in the branch pipes.

Still a further object of this invention is to provide an apparatus and a method for distributing concrete, which allows to drain and cleanse the complete conduit system automatically.

Yet a further object of this invention is to provide an apparatus and a method for distributing concrete which allows using a time control unit to control the start of setting and to automatically drain the whole conduit system before such setting begins.

A further object of this invention is to provide an apparatus and a method for draining and cleansing the whole concrete conduit system in a very small time period.

SUMMARY OF THE INVENTION

The invention comprises an intermediate conduit, one end of which is connected with the supply conduit. A plurality of branch points are provided in series along the intermediate conduit one behind another in spaced relationship, so that the plurality of branch points are arranged along a chain and if a last one of the branch points of such chain is activated to pass concrete through the corresponding branch pipe the concrete must pass all other preceding branch points in the intermediate conduit. Each branch pipe consists of a short preferably straight tube which can be completely filled by a plug to close the branch pipe from the branch point to the mouth thereof within the mould chamber. The intermediate conduit is connected or can quickly be connected with a discharge conduit leading to a fluid operated press out device or a simple cleaning plug inserting device and containing a shut-off device preferably adjacent to the last one of the chain of branch points.

Thanks to this concept all branch pipes can be blocked by inserting the plugs and the whole intermediate conduit and the supply conduit can be drained by activating the press out device especially by blowing or forcing a deformable ball or plug through the conduit system to return the concrete to the neighbourhood of the concrete pump where a receiving container is placed and by means of a pipe switch or two-way valve in the supply conduit the return concrete can be discharged into the container.

It should be understood that the press out device alternatively can be connected with the supply conduit via the two-way valve and the return concrete is then forced through the conduit system and is discharged by the discharge conduit opening into the receiving container.

Especially in lining tunnels the present invention is highly advantageous, because the intermediate conduit can be arranged in circular form in a radial plane immediately adjacent to the annular front mould, so that only very short straight branch pipes are sufficient to connect the intermediate conduit with the injection points of the mould chamber. A shut-off device can preferably be provided behind each branch point in the intermediate conduit as seen in flow direction. This allows to use even a concrete preparation comprising an accelerating admixture because the concrete never comes to a standstill in the whole system comprising the supply conduit, the intermediate conduit and the plurality of branch pipes.

In a concrete distributing apparatus for lining tunnels it is preferred to use an intermediate conduit in the form of a closed circular ring comprising a shut-off means substantially in the lowest part thereof whereby the supply conduit and the discharge conduit are connected with the intermediate conduit at both sides of the shut-off means respectively. The discharge conduit comprises an own shut-off means and the shut-off device and the shut-off means are preferably comprised in form of a two-way valve. One end of the ring-shaped intermediate conduit can be communicated with the other end thereof enabling the concreting process and by adjustment of the valve can alternatively be communicated with the discharge conduit in order to enable the draining process. The supply conduit is always connected with the one end of the ring-shaped intermediate conduit.

Instead of using a fluid operated press-out device comprising a deformable ball or plug which is forced by compressed air or pressurized water through the conduit system also in a simplified plant a reversible concrete pump can be used allowing to return the concrete by suction. In this case the discharge conduit needs only to have a holding device for a deformable cleaning plug which has to be inserted into the discharge conduit. This cleaning plug is sucked back together with the concrete column in the conduit system.

It should be understood that the invention is not limited to an apparatus and a method for distributing concrete in a tunnel but can be used in connection with universal concreting works as laying a foundation plate and erecting columns.

BRIEF DESCRIPTION OF THE DRAWINGS

FIG. 11 and 12 show in detail the embodiment of the modified intermediate conduit according to FIG. 7 in longitudinal and radial cross-sections respectively;

THE DETAILED DESCRIPTION

Figure 1:
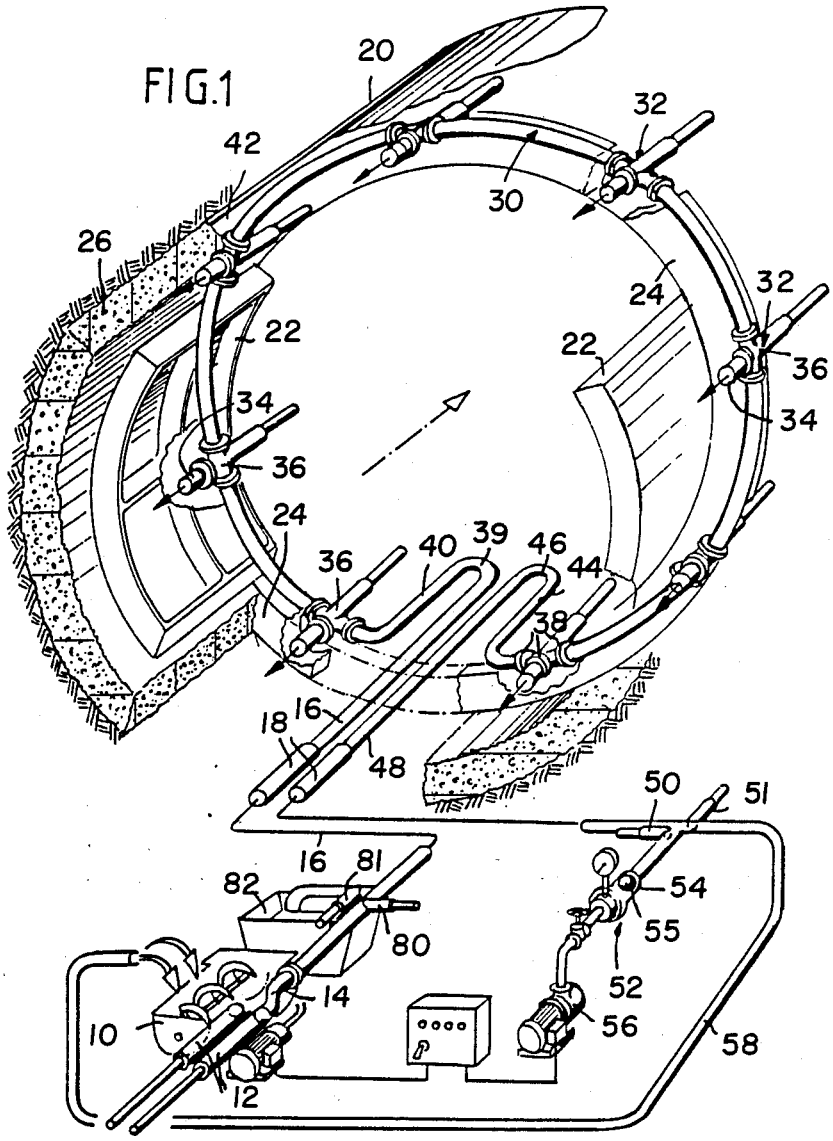
FIG. 1 snows a perspective view of one embodiment of a plant for distributing concrete into a ring-shaped mould chamber of a tunnel.

Referring to the embodiment shown in FIG. 1 to 6 a concrete distributing apparatus for lining a tunnel comprises a concrete mixer 10, a double acting concrete pump 12 with a discharge valve 14 connected with a supply conduit 16 which extends longitudinally within the tunnel and has a length of fifty meters for example. The supply conduit 16 is provided with a lengthening device 18 and extends longitudinally beyond the leading end of a travelling mould comprising an outer ring mould 20, a radially spaced concentric inner mould 22 and an annular front mould 24. These three mould portions together with a previously produced concrete ring or shell 26 at the trailing end form an annular mould chamber 27 which is continuously filled with concrete when the front mould 24 is moved longitudinally together with the outer ring mould 20 at which the front mould 24 is fastened by a drawing-in cylinder 28 supported by an attachment 29 of a frame of a cutting head (not shown).

An intermediate conduit 30 extends in a transverse plane at right angles to the longitudinal axis of the tunnel and immediately ahead of the front mould 24. The intermediate conduit 30 is fastened at the front mould 24 by brackets 25 and also at the inner surface of the outer mould 20 if necessary. The intermediate conduit is circularly bent, and a plurality of branch points 32 are provided along the intermediate conduit at peripheral interspaces. At each branch point 32 a short straight branch pipe 34 is connected with the intermediate conduit. All branch pipes 34 extend longitudinally and parallel with the longitudinal direction of the tunnel and project through the front mould 24 in rearward direction. Each one of the branch pipes 34 is connected with the intermediate conduit by a housing of a valve 36. Three quick-fitting couplings 38 provide for a quick exchange of a valve 36 if necessary. The intermediate conduit 30, as mentioned above, is in the form of a circular ring which is open ended in the bottom region of the tunnel. The ends of the intermediate conduit 30 are represented by valves 36 respectively. The supply conduit 16 is connected with one end of the intermediate conduit 30 by pipe bow 39 running around a front edge of the inner mould 22 comprising a holding ring 76. A substantially straight connecting pipe 40 extends into an annular gap 42 formed between the outer mould 20 and the inner mould 22 and connects the pipe bow 39 with the one end of the intermediate conduit 30, the other end thereof being connected in the same way by a straight connecting pipe 44 and a pipe bow 46 with a discharge conduit 48 extending rearwardly into the tunnel and via a telescoping arrangement 18 and a valve 50 is connected with a fluid-operated press out device 52 comprising an inserting and holding device 54 for a plug 55 and a pressurized fluid source shown in the form of a water pump 56.

A circulating conduit 58 is connected with the discharge conduit 48 and is closed by a valve 51 and leads back into the mixer 10.

Each valve 36 comprises a pipe extension 60 which is coaxially arranged with the branch pipe 34 of each valve 36. The common axis 62 of the branch pipe 34 and the pipe extension 60 intersects a circular axis 64 of the intermediate conduit. A plug 66 is mounted for axial displacement from an open position shown in FIG. 5 within the pipe extension 60 into a closed position (not shown), in which it completely fills the branch pipe 34 and with its front end extends beyond the mouth 68 of the branch pipe 34. The plug 66 is drivingly connected with a driving cylinder 69. The front face 70 of the plug 66 is curved such that smooth transitions are formed between an incoming part **30*a* of the intermediate conduit and the branch pipe 34. A concrete flow is rectangularly deflected by the front face of the plug 66. A nose 72 is formed by the curved front end of the plug and this nose 72 locks an outgoing part 30*b* of the intermediate conduit when the latter is in open position. A cross-channel 74 is formed in the plug 66 near the rearward end thereof and in the closed position of the plug 66 that cross-channel provides a communication between the incoming part 30***a* and the outgoing part 30*b* of the intermediate conduit 30 without any substantial reduction of flow cross-section.

Figure 2:
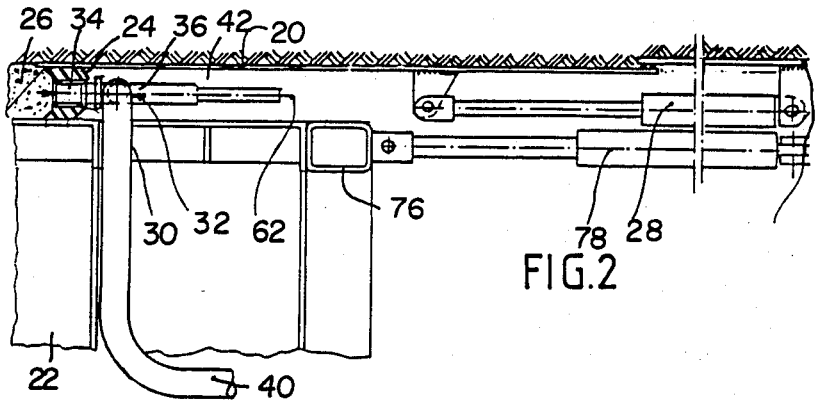
FIG. 2 to 4 show longitudinal sections of a tunnel in successive concreting conditions, using the distributing apparatus shown in FIG. 1.
Figure 3:
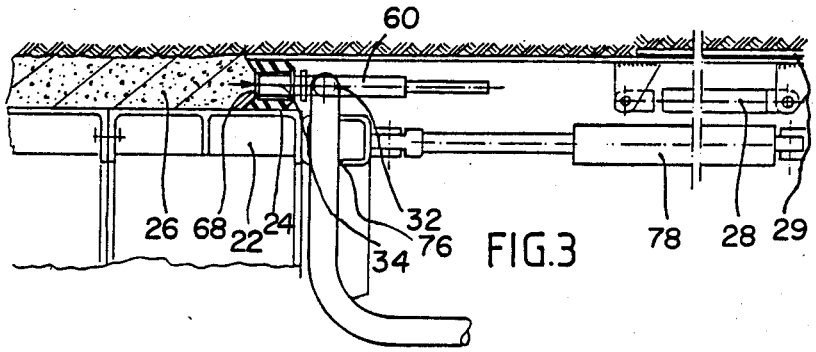
Figure 4:
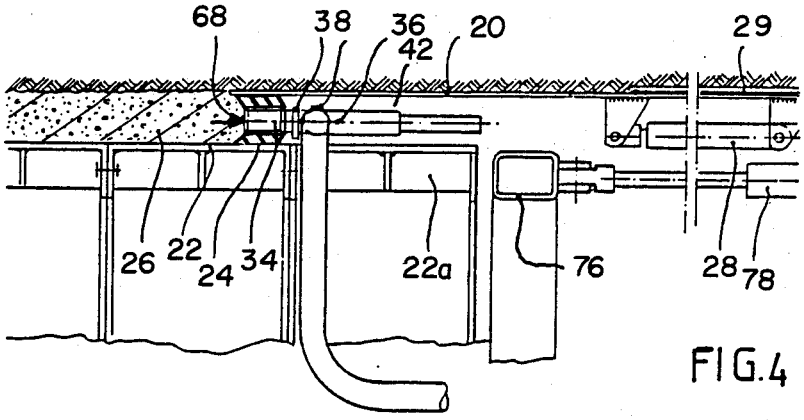

The method for distributing concrete is explained hereafter with reference to FIG. 1 to 6. The concrete ring 26 has been almost completed and a fresh mould ring of the inner mould 22 has been arranged and mounted by a holding ring 76 which is axially forced against the mould ring by a fluid operated cylinder 78 supported by the strut 29. concrete is pumped into the intermediate conduit. The plug 66 of the lowest valve 36 in the left half of the intermediate conduit is open and all other valves 36 are in closed position respectively. Therefore concrete is pumped into the lefthand lower region of the mould chamber. After a certain concrete level has been reached this lowest lefthand valve 36 is closed allowing concrete to pass through cross-channel 74 of this valve into the outgoing part of the intermediate conduit 30. Then another valve 36 for example the lowest righthand one is opened to supply the lower righthand region of the mould chamber after concrete has filled the whole intermediate conduit Then this valve is closed. The connecting pipe 44 leading into the discharge conduit 48 is preferably closed by a shut-off valve (not shown in FIG. 1) to prevent a concrete flow into the connecting pipe. After all other valves 36 have been serviced in the same way a fresh concrete ring has been produced and the front mould 24 together with the intermediate conduit has been displaced correspondingly in forward direction by a simultaneaus operation of the plurality of cylinders 28 from which only one is shown in FIGS. 2 to 4.

After this concreting process has been finished a fresh inner mould ring is mounted as shown in FIG. 4. If for example the mounting work of the inner mould ring becomes retarded or another break-down exists, the valve (not shown) in the connecting pipe 44 and the valve 51 are opened to connect the circulating conduit 58. The the concrete pump is driven slowly to circulate the concrete in the conduit system 16, 30, 48, 58, and thanks to this continuous movement of the concrete setting thereof is retarded. However, in order to avoid draining and cleansing of the conduits 48, 58 alternatively also the press-out device 52 can be activated. The concrete pump 12 is stopped, a valve 80 mounted in the supply conduit 16 is closed to connect the main portion of the supply conduit 16 with a receiving container 82 by opening an outlet valve 81. Then the water pump 56 is operated to press a previously inserted cleaning plug 55 through the conduit system comprising discharge conduit 48, intermediate conduit 30 and a part of the supply conduit 16 and to discharge the concrete contained therein into the receiving container 82. It should be clear that all branch pipes 34 are plugged during this draining process. The water is then drained out of the conduit system for example by compressed air and the whole apparatus is prepared for a fresh concreting process.

FIG. 7 to 12 show another embodiment of an intermediate conduit 130. The valves 36 and the branch pipes 34 are the same as in the embodiment of FIG. 1 to 6. However, the intermediate conduit 130 runs in a cross-plane B which is spaced from the radial plane A of the front mould 24 by an axial length which is greater than the sum of the longitudinal extensions of one inner mould ring 22 and the holding ring 76. That means that the intermediate conduit 130 extends in front of the inner structure comprising the inner mould ring 22 and the holding ring 76, and therefore is arranged outside of the annular gap 42. Because the valves 36, however, remain positioned immediately adjacent the front mould 24 within the annular gap 42 as described before, pairs of connecting pipes 84 are connected with an incoming part and an outgoing part of the intermediate conduit 130 respectively and extend parallely and longitudinally into the annular gap 42. For each one of the valves 36 one pair of connecting pipes 84 is provided. The rearward ends of the pair of connecting pipes 84 are connected with the valve 36 by pipe bows 86 at which are mounted the valve 36 by means of the quick-fitting couplings 38.

Figure 13:
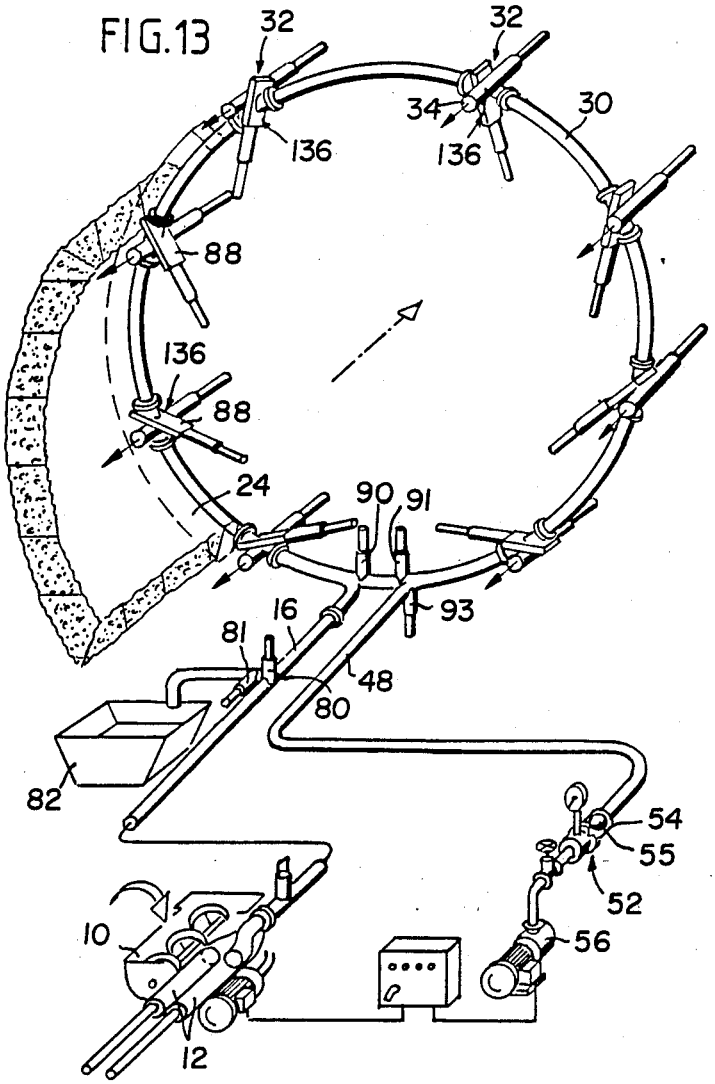
FIG. 13 shows a perspective view of a distributing apparatus comprising a further embodiment of an intermediate conduit.

This embodiment according to FIG. 7 to 12 is used if the mould design requires spaces for attachement at the front mould 24 between any pair of branch pipes 34. Although the intermediate conduit 130 is longer than the intermediate conduit 30 it provides the same principle to connect in series the branch points 32 in order to allow completely draining the conduit system comprising the intermediate conduit 130. As shown in FIG. 12 and 13 the sections of the intermediate conduit 130 are fastened at the outer mould 20 by brackets.

FIG. 13 shows an important embodiment of a distributing apparatus which uses an intermediate conduit 30 provided with a plurality of branch points 32 as described in connection with FIG. 1 to 6. At each branch point 32 a valve 136 is inserted into the intermediate conduit 30. Each one of the valves 136 comprises a separate shut-off slide 88 for closing the intermediate conduit at the outgoing part thereof. The shut-off slides 88 are arranged above the branch points 32 respectively. Both lower ends of the circular intermediate conduit 130 are connected with one another by a connecting tube thus forming a peripherally closed conduit ring. The connecting tube can be closed by valves 90, 91 provided at the ends thereof. A similar valve 93 shuts off the discharge conduit 48. During the concreting process valves 90, 91 are open and valve 93 is closed. For draining the conduit system, valves 90, 81 are closed and valve 93 is opened, thereby connecting the supply conduit 16, the intermediate conduit 30 and the discharge conduit 48 seriesly. The ball 55 or plug then is forced through the system. After having drained the conduit system, the slides 88 of both lowest valves 136 are closed and the valves 90, 91 are opened to drain also the connecting tube.

The additional shut-off slides 88 allow to completely close the outgoing parts of the intermediate conduit 30 at each one of the plurality of branch points 32. Therefore concrete can be discharged through the lefthand lowest branch pipe 34 and thereafter through the lowest righthand branch pipe 34 without having filled the whole intermediate conduit 30, because also the righthand end of the intermediate conduit 30 is connected by valve 90 with the supply conduit 16. This principle is important if concrete without retarding agents is handled, because the dwell periods of non-flowing concrete in the intermediate conduit 30 are reduced. Because the separate shut-off slides 88 provide to shut off the outgoing parts of the intermediate conduit 30 at the branch points 32 when the plug in the branch pipe 34 is in its closed position concrete discharge can be changed from each lefthand valve to each righthand valve 136, nevertheless holding the upstream parts of the intermediate conduit 30 free from concrete.

Figure 17:
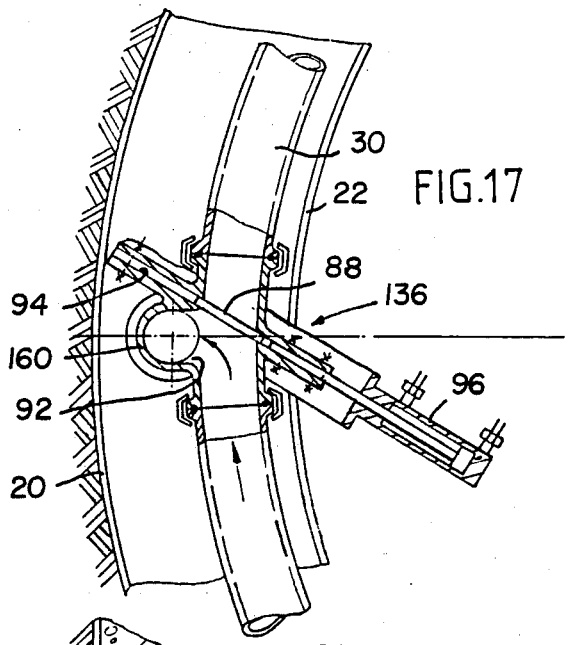
FIG. 17 and 18 show details of the intermediate conduit according to FIG. 13 and represent combined shut-off means for a branch pipe and the intermediate conduit in radial and axial cross-sections of the tunnel.
Figure 18:
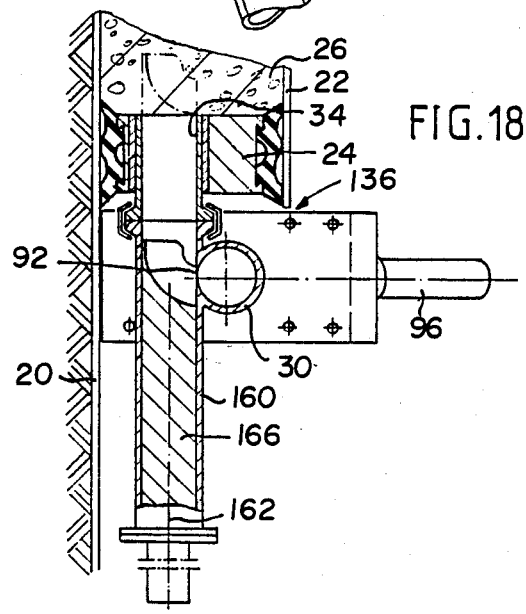
Figure 19:
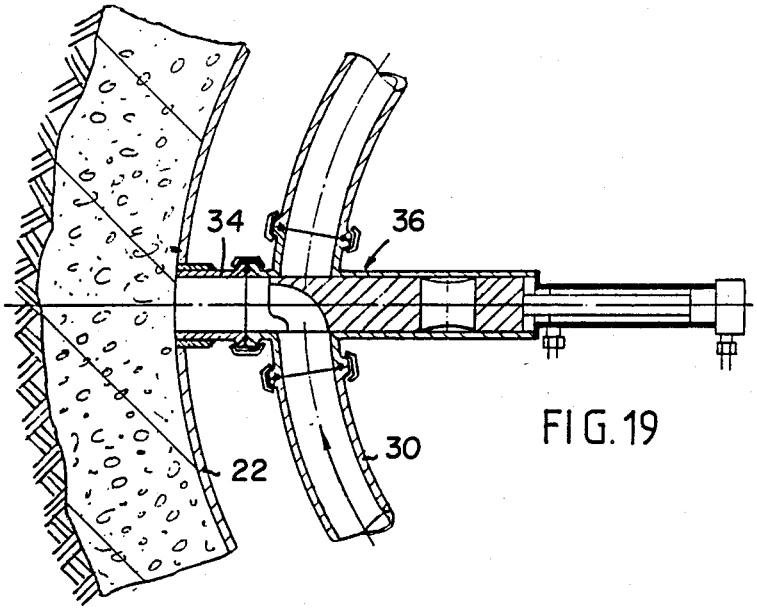
FIG. 19 and 20 show another embodiment of an intermediate conduit for radial concrete supply through an inner mould into an annular mould chamber in radial and longitudinal sectional views respectively.
Figure 20:
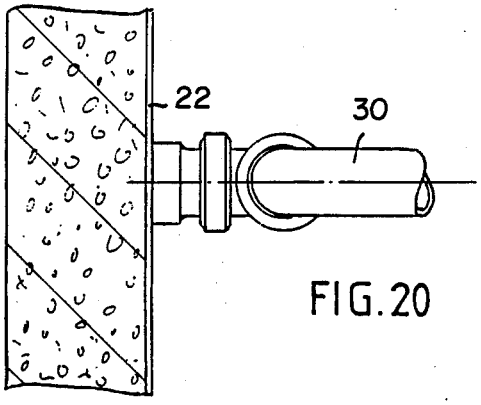

Details of the valve 136 are shown in FIG. 17 and 18. The axis 162 of the branch pipe 34 and the coaxially rearwardly extending tube 160 housing the plug 166 is offset with respect to the circular axis of the intermediate conduit by an amount equal with the sum of the inner radius of the intermediate conduit 30 and the inner radius of the tube 160. Therefore, concrete flows through a peripheral opening 92 in the valve housing into the branch pipe 34. The shut-off slide 88 is displaceably mounted in a slot 94 of the valve housing and is operatively connected with a driving cylinder 96. The plane of the slot 94 is substantially tangential to the tube 160 and forms an angle of 30 degrees with that radial plane of the valve housing intersecting the axis of tube 160. Therefore, the concrete flow into the branch pipe 34 is favourably deflected.

Figure 5:
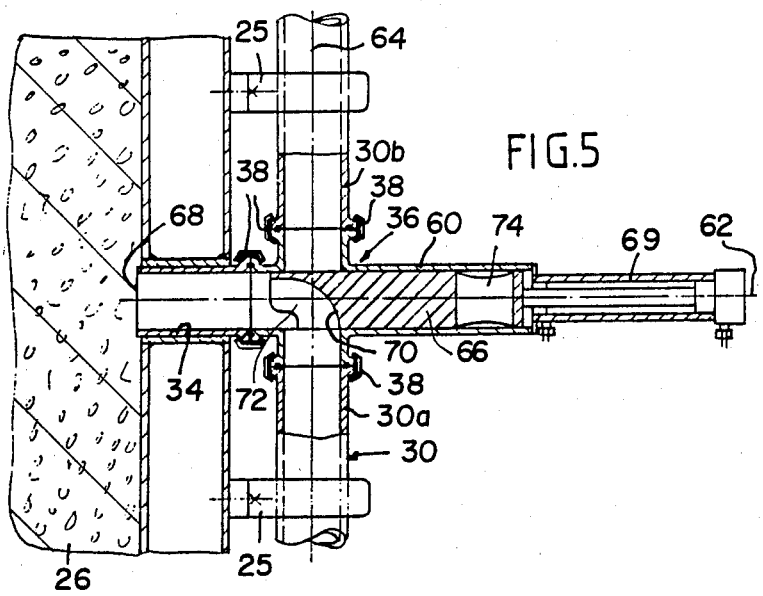
FIG. 5 and 6 show in detail a branch point of the intermediate conduit according to FIG. 1 near an annular front mould in longitudinal and radial cross-sections respectively.
Figure 6:
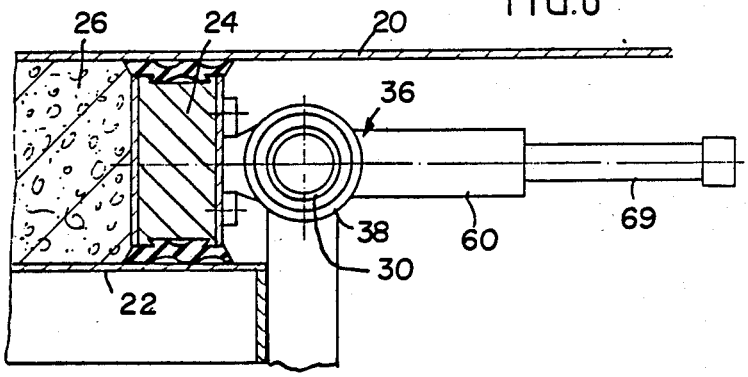
Figure 7:
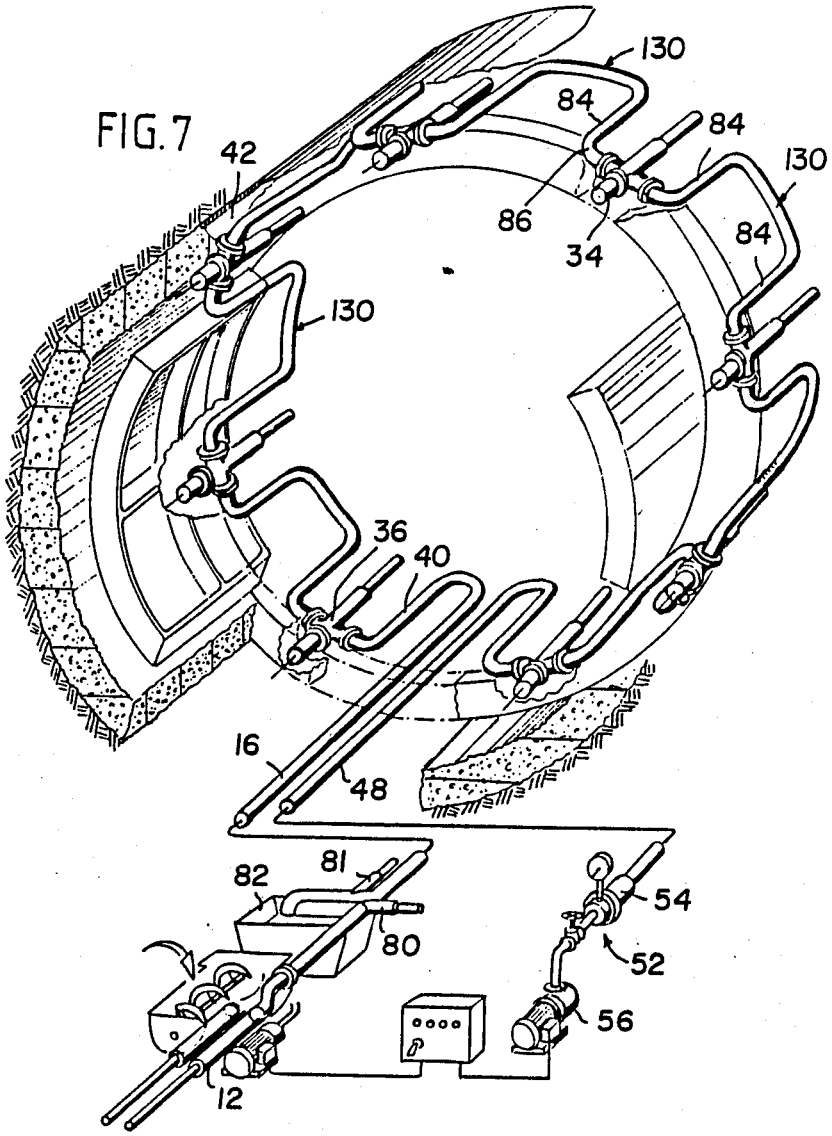
FIG. 7 is a perspective view of a distributing apparatus comprising another embodiment of an intermediate conduit.
Figure 8:
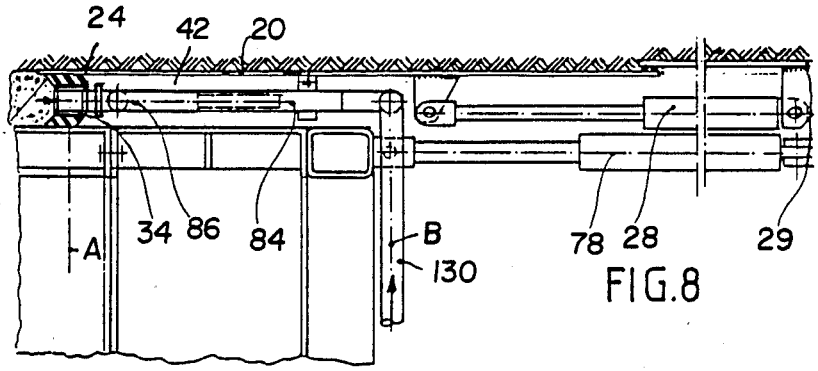
FIG. 8 to 10 show longitudinal sections similar to FIG. 2 to 4, however, using the intermediate conduit as shown in FIG. 7.
Figure 9:
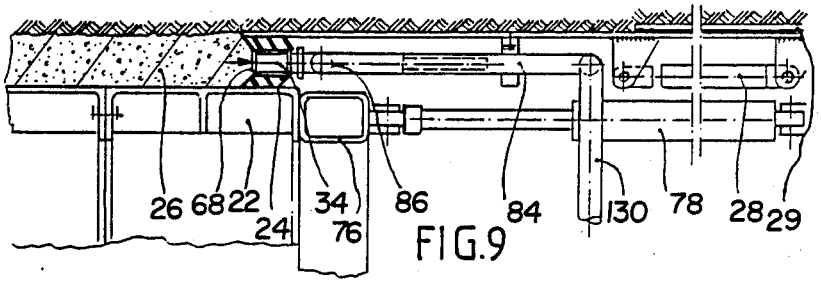
Figure 10:
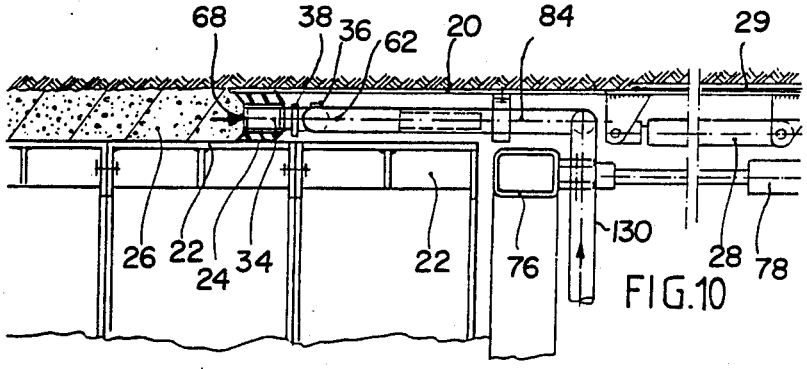

The plug 166 differs from plug 66 shown in FIG. 5 in that the cross channel 74 is omitted. Therefore plug 166 can only open and close the branch pipe 34.

Figure 14:
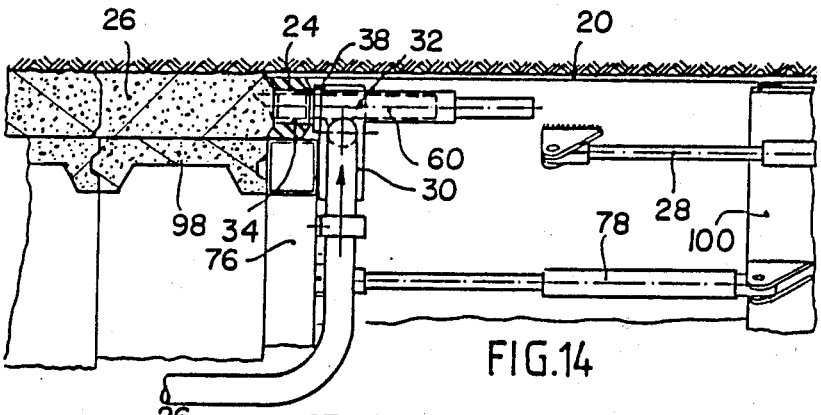
FIG. 14 to 16 show longitudinal sections of a tunnel in successive concreting conditions, using another mould arrangement and using for example the intermediate conduit according to FIG. 13.
Figure 15:
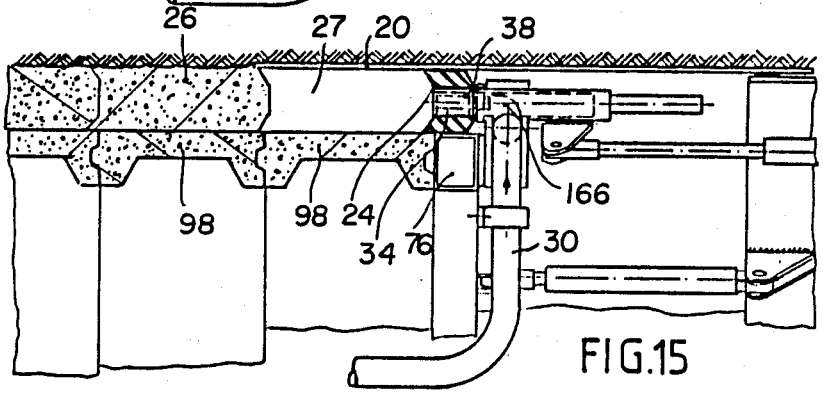
Figure 16:
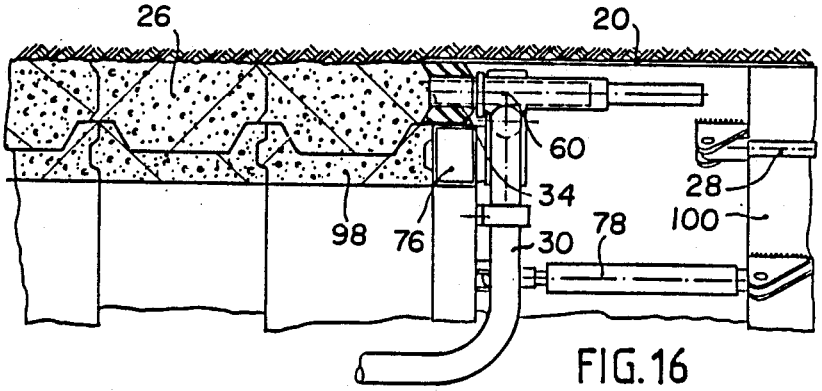

FIG. 14–16 show a branch point 32 of an intermediate conduit 130 in conncection with a mould principle using tubbing segments 98. The leading tubbing segment 98 is pressed against the trailing segments by the holding ring 76 at which the intermediate conduit 130 is mounted. The front mould 24 is mounted at the holding ring 76 and the outer mould 20 can be drawn forwards by cylinder 28. The front mould 24 and the holding ring 76 can be independently moved by cylinder 78 fastened at the trailing end of a travelling frame 100 of the cutting machine.

In FIG. 14 a concrete ring 26 has been completed. In FIG. 15 the holding ring 76 together with the front mould 24 and the intermediate conduit 130 has been drawn forwards and a fresh tubbing ring 98 has been mounted. An annular mould chamber is formed which is filled with concrete according to the method described above. FIG. 16 shows the result after having displaced the outer mould 20 in forward direction. The shut-off slides 88 have been omitted in FIG. 14 to 16.

Figure 21:
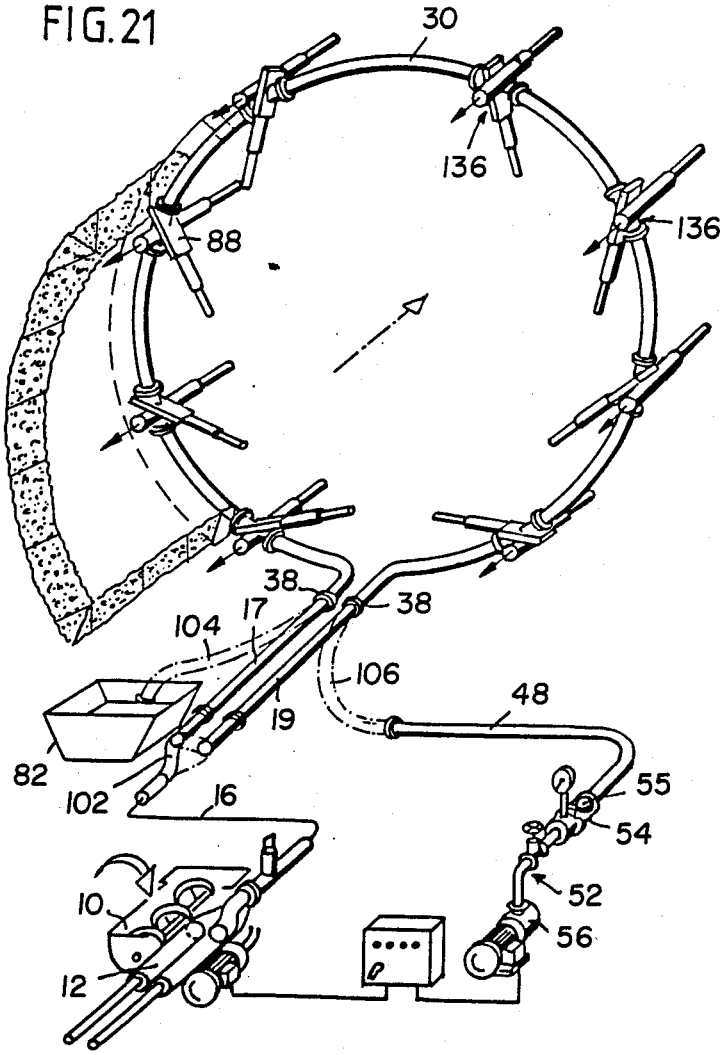
FIG. 21 shows a perspective view of a fourth embodiment of an distributing apparatus which is similar to that one shown in FIG. 13 but somewhat simplified.

FIG. 21 shows a further embodiment of a distributing apparatus. the intermediate conduit 30 including the valves 136 is the same as shown in FIG. 13, however, the connecting tube between the lower ends of the intermediate conduit 30 and the valves 90,91, 93 have been omitted.

A pair of parallel longitudinal supply tubes 17, 19 are connected wilth both ends of the intermediate conduit by quick-fitting couplings 38 respectively. A two-way valve 102 connects the supply conduit with the input ends of the supply tubes 17, 19 alternatively. With the two-way valve 102 in the position shown in FIG. 21 the branch points 32 of the left half of the intermediate conduit are connected with the concrete pump 12. By shifting the two-way valve in the other position shown with dot and dashes the righthand half of the intermediate conduit is activated. If the draining process is to be started, both couplings 38 are removed, the supply tubes 17, 19 are disconnected from the intermediate conduit 30 and two hoses 104, 106 are connected therewith, one hose 104 leading into the receiving container 82 and the other one is connected with the discharge conduit 48.

The embodiments as described above provide means for draining a conduit system comprising the intermediate conduit with all branch points at any time. The draining process can be started manually for example at the end of a working period or automatically upon expiration of a period of time during which the concrete pump has stopped working in order to avoid setting of concrete in the conduit system. The time period can be adjusted in accordance with the properties of the respective concrete preparation.

I claim:

1. A concrete distributing apparatus for tunnel lining comprising a supply conduit extending in longitudinal direction within the tunnel, one end thereof connected with a concrete pump and the other end connected with at least one intermediate conduit extending at least partly along a perimeter of the terminal and substantially in a radial plane of the tunnel, a plurality of branch pipes branching off said intermediate conduit at a plurality of branch points and leading into mould portions respectively, the plurality of branch points arranged in series in series one behind another in spaced relationship along the intermediate conduit, a plurality of valves, each one provided in one of the plurality of branch pipes, close to the intermediate conduit, each one of the plurality of branch pipes consisting of a short tube, each one of the plurality of valves comprising a plug having a length at least as that of the short tube, and a diameter as an inner diameter of the tube, the plug arranged for displacement from a closed position within the tube into an open position, in which it is received in a rearward extension of the short tube to connect the tube with at least an incoming part of the intermediate conduit whereas in the closed position of the plug the tube being completely filled by the plug and blocked against the intermediate conduit.

2. A concrete distributing apparatus as claimed in claim 1, wherein a discharge conduit leading back into the tunnel is connected with the intermediate conduit by a shut-off device and wherein one end of a conduit system comprising at least a portion of the supply conduit, the intermediate conduit and the discharge conduit comprises conduit draining. means and the other end thereof is connectable with a concrete receiving container.

3. A concrete distributing apparatus as claimed in claim 1, wherein the intermediate conduit extends at least partly along a substantially circular path.

4. A concrete distributing apparatus as claimed in claim 3, wherein a pair of substantially arc-shaped intermediate conduits are arranged substantially in the same radial plane of the tunnel, one of them arranged in the left half and the other one in the right half of the tunnel, both intermediate conduits connected with the supply conduit at a downward branch point.

5. A concrete distributing apparatus as claimed in claims 2 or 4, wherein the upper ends of the pair of intermediate conduits are connected with one another and the lower ends thereof are connected with one another by shut-off means, the pair of intermediate conduits thereby forming a peripherally closed circular ring conduit, and wherein the supply conduit and the lockable discharge conduit open into the circular ring conduit immediately adjacent both sides of the shut-off means respectively.

6. A concrete distributing apparatus as claimed in claim 4, wherein the upper ends of the pair of intermediate conduits are connected with the common discharge conduit.

7. A concrete distributing apparatus as claimed in claim 1, wherein the plug is elongated at a peripheral area facing the outgoing part of the intermediate conduit and in its open position shuts up the outgoing part of the intermediate conduit.

8. A concrete distributing apparatus as claimed in claim 1, wherein the plurality of valves comprise shut-off devices respectively arranged in the intermediate conduit immediately downstream the plurality of branch points respectively as seen in concrete flow direction.

9. A concrete distributing apparatus as claimed in claims 1 or 8, wherein the shut-off devices are arranged above the branch points respectively.

10. A concrete distributing apparatus as claimed in claim 9, wherein the shut-off means and the shut-off device are formed by a two-way valve, which connects the lower ends of said pair of intermediate conduits with one another when the discharge conduit is closed by the shut-off device and which blocks a communication between both intermediate conduits when the shut-off device is open.

11. A concrete distributing apparatus as claimed in claim 1, wherein the short tubes have straight axes.

12. A concrete distributing apparatus as claimed in claim 1, wherein the axis of each one of the plurality of short tubes intersects the axis of the intermediate conduit, each plug forms a two-way valve, an incoming part of the intermediate conduit and an outgoing part thereof communicate with one another through a cross-channel provided in the plug when the plug is in its closed position, the plug having a front face designed to close the outgoing part of the intermediate conduit and to communicate the incoming part thereof with the tube when the plug is in its open position.

13. A concrete distributing apparatus as claimed in claim 1, wherein each valve is connected with an incoming part of the intermediate conduit, with an outgoing thereof and with the short tube by three quick-fitting pipe couplings.

14. A concrete distributing apparatus as claimed in claim 1, wherein the intermediate conduit is arranged within an annular gap formed between an outer ring mould and an inner ring mould of the tunnel and wherein the branch pipes extend substantially parallel to the tunnel axis and pass through an annular front mould.

15. A concrete distributing apparatus as claimed in claim 14, wherein the intermediate conduit is arranged in a radial plane adjacent to the annular front mould and is connected with at least one longitudinally extending connecting pipe within the annular gap, and wherein the connecting pipe leads around a front end of an inner mould structure, comprising the inner ring mould and is connected with the supply conduit within the interior of tunnel.

16. A concrete distributing apparatus as claimed in claim 1, wherein the intermediate conduit extends on a diameter at least as great as that of an inner ring mould and extends in a radial plane of the tunnel in front of the inner ring mould, wherein the plurality of branch points are arranged within an annular gap provided between the outer ring mould and the inner ring mould adjacent to an annular front mould and wherein for each one of the plurality of branch points an incoming part and an outgoing part of the intermediate conduit are connected with a pair of longitudinally and rearwardly extending substantially parallel connecting pipes respectively, the pair of connecting pipes connected with one another by a U-shaped pipe bow containing the branch point, so that with the plug in closed position concrete is deflected from its circumverential flow within the intermediate conduit in a longitudinal rearward flow within one of the pair of connecting pipes, then after having passed the U-shaped pipe bow flows longitudinally forward in the other one of the pair of connecting pipes and then again is deflected in circumferential direction to flow into the outgoing part of the intermediate conduit.

17. A concrete distributing apparatus comprising a supply conduit one end thereof connected with a concrete pump and the other one connected with an intermediate conduit extending at least partly along a perimeter of the tunnel a plurality of branch pipes branching off the intermediate conduit at a plurality of branch points and leading to different points of use, the plurality of branch points arranged in series one behind another in spaced relationship along the intermediate conduit as seen in a flow direction, a plurality of valves, each one provided for one of the plurality of branch pipes immediately adjacent the intermediate conduit, each valve comprising a plug displaceably arranged within one of the plurality of branch pipes, the plug connected with a driving device to displace the plug from a closed position within the branch pipe into an open position in which it is received in an opposite extension of the branch pipe in order to communicate the interior of the branch pipe with an incoming part of the intermediate conduit, whereas in the closed position of the plug the branch pipe being completely filled by the plug and locked against the intermediate conduit, a discharge conduit connected with the intermediate conduit comprising a shut-off device, whereby one end of a conduit system comprising at least a portion of the supply conduit, the intermediate conduit and the discharge conduit comprises conduit draining means and the other end thereof is connectable with a concrete receiving container.

18. A concrete distributing apparatus as claimed in claim 17, wherein the conduit draining means comprise a deformable cleaning plug and a high-pressure fluid supply for forcing the plug and the concrete through the conduit system.

19. A method for distributing concrete at a plurality of branch points of use from a common supply conduit through a plurality of branch pipes around a perimeter of a tunnel comprising the steps of providing a conduit system around said perimeter of the tunnel, connecting in series to the conduit system a discharge conduit, an intermediate conduit and at least a portion of the supply conduit, connecting one end of the conduit system with a draining device and connecting the other end with a receiving container then, pumping concrete from the supply conduit into the intermediate conduit containing a plurality of the branch points connected in series by said intermediate conduit, filling a first mould chamber through a first branch pipe and maintaining closed an outgoing part of the intermediate conduit at a first branch point, blocking the first branch pipe by inserting a plug to completely fill the first branch pipe, opening the outgoing part of the intermediate conduit and supplying further mould chambers through further branch points of the intermediate conduit in the same way one after another, and after having supplied all of the plurality of points of use connecting a discharge conduit with the intermediate conduit by opening a shut-off device provided in the discharge conduit and draining the concrete contained in the conduit system into the receiving container.

20. A method as claimed in claim 19, for supplying a plurality of mould chambers forming an annular mould chamber in a tunnel, comprising the steps: providing an intermediate conduit in the left half of the tunnel and a similar intermediate conduit in the right half of the tunnel, connecting both intermediate conduits with the supply conduit in a bottom area of the tunnel pumping concrete alternately into mould chambers of both tunnel halves, beginning at the bottom of the tunnel and continuing the concreting process in upward direction thereby holding the momentary concrete levels substantially on the same height, and after having completely filled the annular mould chamber, stopping automatically the concrete supply and activating the discharging step to drain the conduit system.

21. A method as claimed in claim 19, including continuously measuring the time of the stop period of the concrete pump and upon exceding a predetermined value dependent on the quality of the concrete the draining process is automatically started.

* * * * *